US008512486B2

(12) United States Patent
Koyanagi et al.

(10) Patent No.: US 8,512,486 B2
(45) Date of Patent: Aug. 20, 2013

(54) BETA-TYPE TITANIUM ALLOY AND PRODUCT THEREOF

(75) Inventors: Yoshihiko Koyanagi, Nagoya (JP); Michiharu Ogawa, Nagoya (JP); Tetsuya Shimizu, Nagoya (JP)

(73) Assignee: Daido Tokushuko Kabushiki Kaisha (JP)

( * ) Notice: Subject to any disclaimer, the term of this patent is extended or adjusted under 35 U.S.C. 154(b) by 1014 days.

(21) Appl. No.: 11/730,722

(22) Filed: Apr. 3, 2007

(65) Prior Publication Data

US 2007/0227628 A1 Oct. 4, 2007

(30) Foreign Application Priority Data

| | | |
|---|---|---|
| Apr. 4, 2006 | (JP) | P. 2006-103412 |
| Jan. 19, 2007 | (JP) | P. 2007-010796 |
| Mar. 28, 2007 | (JP) | P. 2007-084778 |

(51) Int. Cl.
*C22C 14/00* (2006.01)

(52) U.S. Cl.
USPC ..... 148/421; 148/407

(58) Field of Classification Search
USPC ..... 148/421, 407
See application file for complete search history.

(56) References Cited

U.S. PATENT DOCUMENTS

| | | | | |
|---|---|---|---|---|
| 2,754,203 | A | 7/1956 | Vordahl et al. | 75/175.5 |
| 2,893,864 | A | 7/1959 | Harris et al. | 75/175.5 |
| 4,040,129 | A | 8/1977 | Steinemann et al. | 3/1.9 |
| 5,176,762 | A * | 1/1993 | Berczik | 148/407 |
| 5,443,510 | A * | 8/1995 | Shetty et al. | 419/2 |
| 5,509,933 | A | 4/1996 | Davidson et al. | 623/16 |
| 5,573,401 | A * | 11/1996 | Davidson et al. | 433/201.1 |
| 5,888,201 | A * | 3/1999 | Stinson et al. | 623/1.2 |
| 2003/0207727 | A1 | 11/2003 | Kakiuchi | 473/345 |

FOREIGN PATENT DOCUMENTS

| | | |
|---|---|---|
| DE | 11 79 006 | 10/1964 |
| JP | 10-219375 | 8/1998 |
| JP | 2000-102602 | 4/2000 |
| JP | 2002-180168 | 6/2002 |
| JP | 2002249836 A | 9/2002 |
| JP | 2004162171 A | 10/2004 |
| JP | 2005-029845 | 2/2005 |
| JP | 2006037150 A | 2/2006 |
| WO | WO 2004/042096 | 5/2004 |

OTHER PUBLICATIONS

Japanese Office Action dated Jan. 17, 2012.

* cited by examiner

*Primary Examiner* — Jessee R. Roe
(74) *Attorney, Agent, or Firm* — Bacon & Thomas, PLLC

(57) ABSTRACT

The present invention provides a beta-type titanium alloy including, by weight %: Nb: 10 to 25%; Cr: 1 to 10%; at least one of Zr: 10% or less and Sn: 8% or less, satisfying Zr+Sn being 10% or less; and the balance of Ti and inevitable impurities, the alloy having Young's modulus of 100 GPa or less, a process for producing the beta-type titanium alloy, and a beta-type titanium alloy product.

14 Claims, No Drawings

BETA-TYPE TITANIUM ALLOY AND PRODUCT THEREOF

FIELD OF THE INVENTION

The present invention relates to a beta-type titanium alloy having biocompatibility and a low Young's modulus and a product using the same as a material. The titanium alloy of the invention is easy to produce and the product can be manufactured at relatively inexpensive costs.

BACKGROUND OF THE INVENTION

As eyeglass flames, orthodontic elements, and biological replacement materials such as artificial bones, biocompatible and light titanium alloys have been employed. The biological replacement material desirably has elastic modulus (Young's modulus) of a low value close to that of the bone (about 30 GPa).

The present applicants has proposed a titanium alloy having a high corrosion resistance and also biocompatibility as a material for artificial bones and the like (Reference 1). This alloy is known under the name of "TNTZ alloy" and a representative alloy composition is Ti-29Nb-13Ta-4.6Zr. However, since the titanium alloy contains large amounts of Nb and Ta which are expensive materials, the alloy is unavoidably expensive as an alloy and also has a disadvantage that it is not easy to produce the alloy by melting since both Nb and Ta have high melting points (melting points of Nb and Ta are 2468° C. and 2996° C., respectively).

Subsequently, the applicant has proposed a Ti alloy having a composition comprising 20 to 60 weight % of Ta, 0.1 to 10 weight % of Zr, and the balance of Ti and inevitable impurities as a "substitute material for hard tissue" (Reference 2). The material exhibits a low Young's modulus in addition to biocompatibility and is suitable as a material for artificial joints and the like. However, since the titanium alloy contains a large amount of Ta which is an expensive material, the alloy is expensive as an alloy and also has the same disadvantage that it is not easy to produce the alloy by melting as in the case of the above TNTZ alloy since Ta has a high melting point as mentioned above.

Furthermore, the applicant has demonstrated an invention relating to "a biomedical Ti alloy and a process for producing the same" (Reference 3). The Ti alloy has an alloy composition comprising, by weight %, Nb: 25 to 35%; Ta in an amount so that Nb+0.8Ta is from 36 to 45%; Zr: 3 to 6%; O, N, and C in amounts so that O+1.6N+0.9C is 0.40% or less; and the balance of Ti and inevitable impurities. The merits of the Ti alloy are the points that it contains no components problematic in toxicity and allergenicity and has Young's modulus of 80 GPa or less but the disadvantage caused by the fact that it contains Ta in a high content still remain as in the case of the above substitute material for hard tissue.

Recently, there is disclosed a "titanium alloy" which has a low melting point and is easy to process, while it also has biocompatibility (Reference 4). This alloy is a beta-type titanium alloy comprising, by weight %, Nb: 25 to 35%; Zr: 5 to 20%; and at least one selected from Cr, Fe, and Si in an amount of 0.5% or more; and the balance of Ti and inevitable impurities. In this alloy, the use of Ti having a high melting point is avoided, and an alloy composition containing low-melting-point element(s) added is selected. However, the alloy still contains a large amount of Nb.

In addition, the production of the conventional titanium alloys uses pure metals as raw materials. Since there are a considerable number of high-melting-point components among the alloy components as mentioned above, production thereof by melting is carried out with difficulty and hence unavoidably costs high.

[Reference 1] JP-A-10-219375
[Reference 2] JP-A-2000-102602
[Reference 3] JP-A-2002-180168
[Reference 4] JP-A-2005-29845

SUMMARY OF THE INVENTION

An object of the invention is to provide a beta-type titanium alloy having biocompatibility and a low Young's modulus, which is easy to produce without using Ta having a high melting point and being expensive, and has reduced amount of Nb, and is capable of producing product thereof at relatively low costs. Objects of the invention also include to provide an advantageous process for producing the titanium alloy and to provide an advantageous process for producing a final product from the alloy.

The present inventors have made eager investigation to examine the problem. As a result, it has been found that the foregoing objects can be achieved by the following beta-type titanium alloys, processes for producing the beta-type titanium alloy, and beta-type titanium alloy products obtained from the beta-type titanium alloys. With this finding, the present invention is accomplished.

The present invention is mainly directed to the following items:

1. A beta-type titanium alloy comprising, by weight %: Nb: 10 to 25%; Cr: 1 to 10%; at least one of Zr: 10% or less and Sn: 8% or less, satisfying Zr+Sn being 10% or less; and the balance of Ti and inevitable impurities, the alloy having Young's modulus of 100 GPa or less.

2. The beta-type titanium alloy according to item 1, which further comprises Al of 6% or less.

3. The beta-type titanium alloy according to item 1, which further comprises Fe of 5% or less.

4. The beta-type titanium alloy according to item 1, which further comprises: Al: 6% or less; and Fe: 5% or less.

5. A process for producing the beta-type titanium alloy according to any one of items 1 to 4, the process comprising: melting a raw material comprising at least one selected from the group consisting of Nb—Cr alloy, Nb—Fe alloy and Nb—Al alloy.

6. A beta-type titanium alloy product obtained from the beta-type titanium alloy according to any one of items 1 to 4 by any one of the following steps: a) melting—cold working; b) melting—solution treatment—cold working; c) melting—cold working—aging treatment; and d) melting—solution treatment—cold working—aging treatment.

7. The beta-type titanium alloy product obtained by casting the beta-type titanium alloy according to any one of items 1 to 4.

Since the beta-type titanium alloy of the invention does not contain Ta having high melting point and being expensive and the content of Nb is from 10 to 25% that is lower than in the conventional titanium alloys, material costs are low and production thereof by melting is easy, so that costs are also reduced in this regard. Young's modulus thereof is 100 GPa or less and is at a level of 60 GPa in a suitable embodiment and hence the alloy is suitable for applications such as artificial bones.

The process for producing the beta-type titanium alloy of the invention uses one or more alloys of Nb—Cr alloy, Nb—Fe alloy, and Nb—Al alloy as part of alloy materials. Utilizing the fact that these alloys show melting points lower than those of pure metals constituting the alloys, the titanium alloys can be easily produced by melting.

The first process for producing a product of the beta-type titanium alloy of the invention can impart a high strength and a low Young's modulus to the product by using a beta-type titanium alloy as a raw material, performing a cold working or a solution treatment—cold working to be formed into a product shape. By further performing an aging treatment, a high strength can be attained.

In the present invention, the above expression using the sign "—", such as "melting—cold working", means that each treatments are carried out in this order. For example, "melting—cold working" means that the melting and the cold working are carried out in this order.

The beta-type titanium alloy product according to the invention is useful as biological replacement parts such as artificial tooth roots, artificial knee joints, plates/screws for fixing fractured bone, and volts for fractured bone surgery.

DETAILED DESCRIPTION OF THE INVENTION

The beta-type titanium alloy of the invention may have an alloy composition containing any of the following elements as elements to be optionally added to the above essential alloy elements:

a) 6% or less of Al, b) 5% or less of Fe, or c) 6% or less of Al and 5% or less of Fe.

The following will describe functions of individual components constituting the beta-type titanium alloy of the invention and reasons for limiting the composition ranges as mentioned above.

Nb: 10 to 25%

Nb is a β-phase stabilizing element of isomorphous-type which is considered to have no cytotoxicity and has a function of making a matrix a β-phase having a low Young's modulus and a high cold workability. In order to surely obtain the effect, it is necessary to add Nb in an amount of 10% or more. On the other hand, the presence of a large amount of Nb deteriorates producibility, so that the addition thereof is limited to 25% or less.

According to an embodiment, the minimal amount present in the alloy is the smallest non-zero amount used in the examples of the developed alloys as summarized in Table 1. According to a further embodiment, the maximum amount present in the alloy is the maximum amount used in the examples of the developed alloys as summarized in Table 1.

Cr: 1 to 10%

Cr is also a β-phase stabilizing element and has a function of lowering Young's modulus. The effect is first observed when Cr is added in an amount of 1% and becomes more remarkable when it is added in an amount of 3% or more. However, when the amount exceeds 8%, the effect begins to be saturated. When it exceeds 10%, the effect is clearly saturated, so that the upper limit is defined to be 10%.

According to an embodiment, the minimal amount present in the alloy is the smallest non-zero amount used in the examples of the developed alloys as summarized in Table 1. According to a further embodiment, the maximum amount present in the alloy is the maximum amount used in the examples of the developed alloys as summarized in Table 1.

One or two elements of Zr: 10% or less and Sn: 8% or less

Both Zr and Sn are elements stabilizing both α-phase and β-phases and strengthen the α-phase which precipitates in aging treatment. The effect is observed when about 1% of either element is added but is remarkable when 3% or more thereof is added. However, when the amount thereof exceeds from 5 to 6%, the effect of the addition begins to be saturated, so that the upper limit is defined to be 10% for Zr and 8% for Sn.

According to an embodiment, the minimal amount present in the alloy is the smallest non-zero amount used in the examples of the developed alloys as summarized in Table 1. According to a further embodiment, the maximum amount present in the alloy is the maximum amount used in the examples of the developed alloys as summarized in Table 1.

The changed embodiments on the alloy composition of the beta-type titanium alloy of the invention have the following meanings, respectively.

a) Addition of 6% or less of Al

Al is an α-phase stabilizing element and strengthens the α-phase which precipitates in aging treatment. The effect has already been observed remarkably when about 1% thereof is added. However, when the amount thereof exceeds 4%, the effect begins to be saturated. When it exceeds 6%, the effect is clearly saturated, so that the upper limit of the amount to be added is defined to be 6%. In addition, there is an inconvenience that elastic modulus increases when the amount exceeds 4%.

According to an embodiment, the minimal amount present in the alloy is the smallest non-zero amount used in the examples of the developed alloys as summarized in Table 1. According to a further embodiment, the maximum amount present in the alloy is the maximum amount used in the examples of the developed alloys as summarized in Table 1.

b) Addition of 5% or less of Fe

Fe is a β-phase stabilizing element and has an effect similar to that of Nb and Cr. Moreover, since it is an inexpensive material, costs can be lowered by the use thereof. However, the addition of a large amount of Fe increases hardness and elastic modulus, so that the addition is limited to 5% or less, desirably 2% or less.

According to an embodiment, the minimal amount present in the alloy is the smallest non-zero amount used in the examples of the developed alloys as summarized in Table 1. According to a further embodiment, the maximum amount present in the alloy is the maximum amount used in the examples of the developed alloys as summarized in Table 1.

Nb—Cr alloy, Nb—Fe alloy, and Nb—Al alloy to be used as materials to be melted in the process for producing the beta-type titanium alloy of the invention all have melting points lower than those of pure metals constituting these alloys (approximate melting points of Nb—Cr alloy, Nb—Fe alloy, and Nb—Al alloy are 1700 to 1800° C., 1500 to 1600° C., and 1550 to 1650° C., respectively) and hence the titanium alloy can be easily produced by melting.

The solution treatment, cold working, and aging treatment performed in the process for producing a product of the beta-type titanium alloy of the invention can be carried out according to known techniques.

EXAMPLES

The present invention is now illustrated in greater detail with reference to Examples and Comparative Examples, but it should be understood that the present invention is not to be construed as being limited thereto.

Example 1

Button ingots of titanium alloys each having a weight of 150 g and a size of length 70 mm×width 25 mm×height 25 mm were prepared by arc-melting using sponge titanium and the other raw materials in a ratio shown in Table 1 (weight %, the balance being Ti). The each ingot was heated to 1050° C. and formed into a plate having a size of length 85 mm×width 60 mm×thickness 4 mm by hot forging. Then, the each plate was subjected to solution treatment to form a material under test, wherein the each plate was maintained at 850° C. for 1 hour and then quenched in water.

From the above material under test, each test piece for tensile test in accordance with JIS Z 2201 (JIS No. 14B) was manufactured by machining. Using an Instron-type tensile testing machine, tensile strength was measured at a cross head speed of $5\times10^{-5}$ m/s. Separately, from the above material under test, each test piece for elastic modulus in accordance with JIS Z 2280 was manufactured and Young's modulus was measured by a free resonant vibration method. The results of the measurements are also shown in Table 1.

TABLE 1

(weight %, the balance being Ti)

| Section | No. | Nb | Cr | Zr | Sn | Al | Fe | Remark | Tensile strength (MPa) | Young's modulus (GPa) |
|---|---|---|---|---|---|---|---|---|---|---|
| Example | 1 | 10.2 | 7.12 | 4.02 | — | — | — | | 751 | 87 |
| | 2 | 12.1 | 7.80 | — | 3.90 | — | — | | 768 | 80 |
| | 3 | 11.8 | 7.93 | 1.95 | — | 1.10 | — | | 777 | 83 |
| | 4 | 14.7 | 6.81 | 4.80 | — | — | — | | 746 | 78 |
| | 5 | 15.0 | 2.98 | 3.95 | — | — | — | | 766 | 100 |
| | 6 | 14.7 | 4.98 | — | 4.03 | — | — | | 653 | 81 |
| | 7 | 14.9 | 4.05 | 3.94 | — | — | — | | 713 | 87 |
| | 8 | 15.0 | 5.02 | 3.87 | — | — | — | | 734 | 83 |
| | 9 | 15.3 | 7.15 | 1.73 | 2.20 | — | — | | 721 | 76 |
| | 10 | 15.0 | 6.94 | — | 3.90 | — | — | | 697 | 74 |
| | 11 | 18.3 | 4.00 | 3.98 | — | — | 1.07 | | 775 | 85 |
| | 12 | 18.9 | 5.83 | — | 0.90 | 2.10 | — | | 713 | 75 |
| | 13 | 19.6 | 3.04 | 3.81 | — | — | — | | 589 | 90 |
| | 14 | 19.8 | 4.01 | 5.80 | — | — | — | | 653 | 69 |
| | 15 | 20.3 | 4.00 | 3.94 | — | — | — | | 595 | 73 |
| | 16 | 20.1 | 4.98 | 0.52 | — | 3.99 | — | | 798 | 86 |
| | 17 | 20.2 | 5.02 | 3.87 | — | — | — | | 573 | 67 |
| | 18 | 19.9 | 4.90 | 4.38 | 1.16 | 0.90 | — | | 618 | 68 |
| | 19 | 20.1 | 5.10 | — | 2.41 | 1.20 | — | | 616 | 69 |
| | 20 | 22.0 | 5.11 | 5.24 | — | — | — | | 648 | 70 |
| | 21 | 20.0 | 3.96 | — | 3.98 | — | — | | 540 | 66 |
| | 22 | 22.4 | 3.78 | 2.88 | 1.32 | — | 0.50 | | 650 | 73 |
| | 23 | 24.9 | 3.00 | — | 3.91 | — | — | | 583 | 69 |
| | 24 | 24.8 | 3.92 | — | 4.80 | — | — | | 595 | 70 |
| | 25 | 24.7 | 1.96 | 0.81 | 1.00 | 1.90 | 1.20 | | 672 | 71 |
| | 26 | 24.9 | 2.99 | 3.88 | — | — | — | | 547 | 70 |
| | 27 | 25.0 | 3.98 | 3.87 | — | — | — | | 595 | 67 |
| | 28 | 25.0 | 5.00 | 3.91 | — | — | — | | 701 | 71 |
| Comparative Example | 1 | — | — | — | — | — | — | Ti 100 | 487 | 110 |
| | 2 | — | — | — | — | 6.00 | — | V 4.0 | 980 | 110 |
| | 3 | 7.00 | — | — | — | 6.00 | — | | 988 | 105 |
| | 4 | 5.0 | 15.0 | — | — | — | — | | 1050 | 105 |

The titanium alloys of Examples 1 to 28 of the invention show elastic modulus of 100 GPa or less, and, in preferable examples, values of less than 70 GPa, while they have alloy compositions maintaining a high biocompatibility. Therefore, they are suitable as biological replacement materials.

Example 2

A titanium alloy having a composition shown in Table 3 was produced by melting using a pure Ti (titanium sponge) and one to three of Nb—Cr alloy, Nb—Fe alloy, and Nb—Al alloy in a composition (weight ratio) shown in Table 2 as material(s) to be melted. Appropriate melting points of the raw alloys are shown in Table 2 and approximate temperatures of the furnace (button arc furnace) in the alloy produced by melting are shown in Table 3.

TABLE 2

| Raw material to be melted | Nb (%) | Cr (%) | Fe (%) | Al (%) | Approximate melting point (° C.) |
|---|---|---|---|---|---|
| Nb—Cr alloy | 80 | 20 | — | — | 1700 to 1800 |
| Nb—Fe alloy | 66.5 | — | 33.5 | — | 1500 to 1600 |
| Nb—Al alloy | 60 | — | — | 40 | 1550 to 1650 |

TABLE 3

| Titanium alloy produced by melting | Raw material | Maximum heating temperature for melting |
|---|---|---|
| Ti—18Nb—4Cr—4Zr—1Fe | Titanium sponge, Nb—Cr, Nb—Fe, pure Zr | 1800 |
| Ti—20Nb—5Cr—2Zr—2Sn | Titanium sponge, Nb—Cr, pure Zr, pure Sn | 1800 |
| Ti—20Nb—5Cr—3Zr—1Al | Titanium sponge, Nb—Cr, Nb—Al, pure Zr | 1800 |
| Ti—18Nb—4Cr—2Zr—1Fe—2Sn | Titanium sponge, Nb—Cr, Nb—Fe, pure Zr, pure Sn | 1800 |
| Ti—18Nb—4Cr—3Zr—1Fe—1Al | Titanium sponge, Nb—Cr, Nb—Fe, Nb—Al, pure Zr | 1800 |
| Ti—18Nb—4Cr—2Zr—1Fe—1Sn—1Al | Titanium sponge, Nb—Cr, Nb—Fe, Nb—Al, pure Zr, pure Sn | 1800 |
| Ti—20Nb—5Cr—4Zr | Titanium sponge, pure Nb, pure Cr, pure Zr | 2500 |

It is apparent from Table 3 that heating should be conducted at a temperature reaching about 2500° C. until melting when only pure metals are combined as raw materials but the temperature can be lowered to 1800° C. by the use of the alloy(s) and hence the titanium alloys can be easily produced.

While the present invention has been described in detail and with reference to specific embodiments thereof, it will be apparent to one skilled in the art that various changes and modifications can be made therein without departing from the spirit and scope thereof.

The present application is based on Japanese Patent Application No. 2006-103412 filed on Apr. 4, 2006, No. 2007-010796 filed on Jan. 19, 2007 and No. 2007-084778 filed on Mar. 28, 2007, and the contents thereof are incorporated herein by reference.

What is claimed is:

1. A biocompatible beta titanium alloy comprising, by weight %:

Nb: 10 to 25%;

Cr: 1 to 10%;

and

Zr and Sn in a stabilizing amount for both alpha phase and beta phase and to strengthen the alpha phase and satisfying Zr+Sn being 10% or less; and the balance of Ti and inevitable impurities, the alloy having Young's modulus of 100 GPa or less.

2. The beta titanium alloy according to claim 1, which further comprises Al of 6% or less.

3. The beta titanium alloy according to claim 1, which further comprises Fe of 5% or less.

4. The beta titanium alloy according to claim 1, which further comprises:

Al: 6% or less; and

Fe: 5% or less.

5. A beta titanium alloy product obtained from the beta-type titanium alloy according to claim 1 by any one of the following steps:

a) melting—cold working;

b) melting—solution treatment—cold working;

c) melting—cold working—aging treatment; and d) melting—solution treatment—cold working—aging treatment.

6. A beta-type titanium alloy product obtained from the beta titanium alloy according to claim 2 by any one of the following steps:

a) melting—cold working;

b) melting—solution treatment—cold working;

c) melting—cold working—aging treatment; and d) melting—solution treatment—cold working—aging treatment.

7. A beta titanium alloy product obtained from the beta titanium alloy according to claim 3 by any one of the following steps:

a) melting—cold working;

b) melting—solution treatment—cold working;

c) melting—cold working—aging treatment; and d) melting—solution treatment—cold working—aging treatment to make an artificial bone.

8. A beta titanium alloy product obtained from the beta titanium alloy according to claim 4 by any one of the following steps:

a) melting—cold working;

b) melting—solution treatment—cold working;

c) melting—cold working—aging treatment; and d) melting—solution treatment—cold working—aging treatment.

9. The beta titanium alloy product obtained by casting the beta titanium alloy according to claim 1.

10. The beta titanium alloy product obtained by casting the beta titanium alloy according to claim 2.

11. The beta titanium alloy product obtained by casting the beta titanium alloy according to claim 3.

12. The beta titanium alloy product obtained by casting the beta titanium alloy according to claim 4.

13. The beta titanium alloy of claim 1 which has a Young's modulus of less than 70 GPa.

14. The beta titanium alloy of claim 1 wherein Al is present at about 1%.

* * * * *